US012016403B1

(12) United States Patent
Bastug et al.

(10) Patent No.: US 12,016,403 B1
(45) **Date of Patent: *Jun. 25, 2024**

(54) SUSTAINABLE BRA GARMENT AND IMPROVED BIO-BASED OPEN CELL FOAM PAD PORTIONS

(71) Applicant: Gelmart Industries, Inc., New York, NY (US)

(72) Inventors: Eve Bastug, North Haledon, NJ (US); Giancarlos Delevati, New York, NY (US); Yoseph Nasser, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/388,410

(22) Filed: Nov. 9, 2023

(51) Int. Cl.
*A41C 3/14* (2006.01)

(52) U.S. Cl.
CPC ..... *A41C 3/144* (2013.01)

(58) Field of Classification Search
CPC ..... A41C 3/144
USPC ..... 450/57
See application file for complete search history.

(56) References Cited

U.S. PATENT DOCUMENTS

| | | | | |
|---|---|---|---|---|
| 8,240,174 | B2 | 8/2012 | Soeda | |
| 8,696,643 | B2 | 4/2014 | Knightingale | |
| 8,956,199 | B2 | 2/2015 | Liu | |
| 9,609,897 | B2 | 4/2017 | Siddall-Cohen | |
| 9,788,578 | B2 | 10/2017 | Betts | |
| 9,961,946 | B2 | 3/2018 | Calhoun | |
| 11,330,849 | B2 * | 5/2022 | Bastug | A41C 3/144 |
| 2005/0075048 | A1 | 4/2005 | Legaspi | |
| 2009/0311943 | A1 | 12/2009 | Mone | |
| 2010/0319409 | A1 | 12/2010 | Soeda | |
| 2013/0165017 | A1 | 6/2013 | Liu | |
| 2014/0283273 | A1 | 9/2014 | Falken | |
| 2016/0045841 | A1 * | 2/2016 | Kaplan | C01B 32/05 429/49 |

(Continued)

FOREIGN PATENT DOCUMENTS

| | | | |
|---|---|---|---|
| CN | 104829876 | A | 8/2015 |
| CN | 112204090 | A | 1/2021 |

OTHER PUBLICATIONS

The State Intellectual Property Office of People's Republic of China, First Office Action Re: CN117377404A (National Phase Application of PCT /US/2021/041461-Filed Jul. 13, 2021; Applicant-Gelmart Industries, Inc.); Dated Mar. 18, 2024.

*Primary Examiner* — Gloria M Hale
(74) *Attorney, Agent, or Firm* — gunnercooke US LLP; John R. Lane

(57) ABSTRACT

A sustainable bra garment that includes first and second cup portions that are formed of one or more recycled flexible materials and having first and second cushioning support pads formed of a bio-based foam material The first and second cushioning support pads are configured to be coupled with the first and second cup portions, respectively. The front surface of each pad has a generally convex shape and the back surface of each pad has a generally concave shape. Each of the pads is formed of a bio-based material, such as a sugar cane-based open cell foam that has hardness and density values that provide both cushioning and support to breasts of a wearer of the sustainable bra garment. The cushioning support pads may be used with a bra garment or with other garments such as swimwear and other apparel where bra support pads can be incorporated.

30 Claims, 9 Drawing Sheets

(56) References Cited

U.S. PATENT DOCUMENTS

| | | | |
|---|---|---|---|
| 2016/0302492 | A1 | 10/2016 | Sobah |
| 2017/0095010 | A1 | 4/2017 | Fildan |
| 2018/0084841 | A1 | 3/2018 | Calhoun |
| 2019/0261699 | A1 | 8/2019 | Rushton |
| 2019/0315948 | A1 | 10/2019 | Delevati |
| 2020/0229513 | A1 | 7/2020 | Dowdle |
| 2021/0070956 | A1 | 3/2021 | Delevati |

* cited by examiner

SUSTAINABLE BRA GARMENT AND IMPROVED BIO-BASED OPEN CELL FOAM PAD PORTIONS

BACKGROUND

The present application relates generally to a bra garment and more particularly to bra garments, including improved bra pad portions formed of bio-based polymeric open cell foam materials, as contrasted with petroleum-based foam pad materials.

Bras are commonly worn by women to provide support for their breasts and for enhanced shape and appearance. Other garments have built-in bras and can provide the same function. Proper support for the wearer is important for bras and thus dictates the type of materials that can be used, particularly for the pads of the bra used for shaping and support as desired, which are typically formed of petroleum-based polymeric foams that are not recyclable. As such, foam pads are usually attached to the bra using a glue. The foam material and glue, however, can be toxic for the humans during its production process and to the wearer and is not recyclable or environmentally friendly. There is therefore a need for improved environmentally friendly bra garments, particularly bra garments having foam pad portions formed of recyclable and/or bio-based materials to make bra products more environmentally friendly and sustainable. The improved bio-based recyclable support pads of the present invention may be used with a bra garment or with other garments such as swimwear and other apparel where bra support pads can be incorporated.

In U.S. Pat. No. 11,330,849 (issued May 17, 2022), which is incorporated herein by reference, the same applicant and inventors described and claimed bra garments utilizing cup portions made from Bio-Based ethylene vinyl acetate ("EVA") foam comprised of a substantially Bio-Based ethanol component, having 60-85% sugar cane-based ethanol, with the balance of the EVA foam having fossil fuel-based ethanol and vinyl acetate, resulting in an EVA foam having a closed-cell structure ("Closed Cell Foam"). There is a need for further improved bra cup portions to be comprised of a greater percentage of bio-based polymer materials having an open-cell structure, as provided by the present invention ("Open Cell Foam"), such that a preferred percentage of Bio-Based EVA is combined with a preferred percentage of Bio-Based Polyethylene ("Bio-Based PE") to form an Open-Cell Foam for the formation of even softer yet sufficiently structurally supportive bra cup portions than those described and claimed in U.S. Pat. No. 11,330,849. The bio-based polymer materials may also comprise a preferred percentage of Bio-Based EVA alone to form an Open-Cell Foam for making softer yet sufficiently structurally supportive bra cup portions of the present invention.

SUMMARY

The present disclosure may provide a sustainable bra garment that comprises first and second cup portions that include bra pad portions formed of one or more Bio-Based Open-Cell Foam materials and first and second side wing panels that are formed of recycled flexible materials and extend from the first and second cup portions, respectively. First and second cushioning support pads are configured to be coupled with the first and second cup portions, respectively. Each of the bra pad portions has front and back surfaces wherein the front surface of each pad that has a generally convex shape and the back surface of each pad that has a generally concave shape. Each of the pads is formed of a Bio-Based Open Cell Foam material that has hardness and density values that provide both cushioning and support to breasts of a wearer of the bra garment. The pads formed of a Bio-Based Open Cell foam material may also be used within other types of garments and apparel, such as bras, maternity bras, sports bras, swimwear, camisoles, bustiers, t-shirts and other apparel where bra support pads can be incorporated.

In certain embodiments, the Open Cell Bio-Based foam material is comprised of a sugarcane-based polymer foam material made from a mixture of Bio-Based EVA and Bio-Based PE (among other materials) that is non-toxic to the wearer. Each pad can also be devoid of a lamination or glue layer on at least the back surface thereof; the one or more recycled materials of the first and second cup portions and the first and second side wing panels is one or more recycled fabrics; and/or the first and second cup portions and the first and second side wing panels are formed of the same recycled fabric.

In other embodiments, the bra garment further comprises elastic shoulder straps attached between the first cup portion and the first side wing panel and between the second cup portion and the second side wing panel, respectively, and the elastic shoulder straps are formed of recycled materials; each of the shoulder straps include an adjustable element for adjusting the length of the shoulder straps, the adjustable element is formed of a sustainable material that has a hardness value that is greater than the hardness value of the sustainable material of the pads; each of the first and second cup portions has an underwire channel; further comprising a bridge panel that joins the first and second cup portions, and the bridge panel is formed of a recycled material; and/or the free ends of the first and second side wings panels include corresponding clasp elements for clasping the free ends together.

The present disclosure principally provides for first and second cushioning support pads comprised of Bio-Based Open Cell Foam, which are retained in the receiving areas of the first and second cup portions of a bra garment, respectively. Each of the pads has front and back surfaces that correspond to the outer and inner pieces of the first and second cup portions, respectively. The front surface of each pad has a generally convex shape and the back surface of each pad has a generally concave shape. Each of the pads is formed of only a bio-based material that has hardness and density values that provide both cushioning and support to breasts of a wearer of the sustainable bra garment.

In preferred embodiments, pad portions can be manufactured with environment-friendly materials, such as sugar cane-based polymer known in the art as Green or Bio-Based EVA material. Bio-Based EVA materials are known in the art and have been developed and used previously for the production of the soles of certain specialty footwear products [See https://www.forbes.com/sites/veenamccoole/2018/08/1/allbirds-launches-flip-flops-made-from-sustainable-sugarcane/?sh=55cd98913672 and https://materialdistrict.com/article/flip-flops-sugarcane-foam/]. However, in the present invention it has been found that a Bio-Based EVA material can be more specifically formulated and processed to produce a softer and yet structurally sound foam polymer material appropriate for use as a bra pad. In the present invention, preferred foaming methods are disclosed for use in forming molded bra pad products from Bio-Based EVA's, that have the flexibility and structural qualities of petroleum-based EVA's, but that are recyclable after the useful life of the pad is reached for a typical bra pad product. Also the outer piece of each cup portion may be formed of a recycled nylon and the inner piece of each cup portion is formed of recycled polyester; the bra garment further comprises elastic shoulder straps attached between the first cup portion and the first side wing panel and between the second cup portion and the second side wing panel, respectively, and the elastic shoulder straps are formed of recycled fabric; and/or each of the first and second cup portions has an underwire channel and a bridge panel joins the first and second cup portions, and both the underwire channel and the bridge panel are formed of a recycled material.

Conventional fossil fuel based foams (such as polyurethane foams) are produced by a process of sheeting, molding and extrusion from compounded gum rubber and formulated using a number of raw ingredients including chemicals, liquid polymers such as polyol, polyisocyanates, toluene diisocyanate and additives which act as catalysts to increase production speed and blowing agents to create gas bubbles during foam formulation. Surfactants such as silicone or polyethers are also used to control the size of the bubbles. The physical properties of conventional fossil fuel based foams are dependent on the alloy composition and reaction temperature at the production stage.

The present disclosure provides a sustainable bra garment that comprises first and second cup portions with cushioning support pads formed from Bio-Based Open Cell Foam that is substantially devoid of fossil fuel-based material. Each of the first and second cup portions has an outer piece and an inner piece. The inner and outer pieces are attached to one another at respective perimeters thereof forming a pad receiving area therebetween. The inner and outer pieces are formed of one or more recycled fabrics. The first and second side wing panels extend from the first and second cup portions, respectively. The first and second side wing panels are formed of one or more recycled fabrics. First and second cushioning support pads are retained in the receiving areas of the first and second cup portions, respectively. Each of the pads has front and back surfaces that correspond to the outer and inner pieces of the first and second cup portions, respectively. The front surface of each pad has a generally convex shape and the back surface of each pad has a generally concave shape. As disclosed herein each of the pads is formed of a Bio-Based Open Cell Foam. with hardness and density values that provide both cushioning and support to breasts of a wearer of the sustainable bra garment, and that is non-toxic to the wearer. Substantially, each portion of the sustainable bra garment is formed of either recycled or Bio-Based materials.

In certain embodiments, the bra garment further comprises elastic shoulder straps attached between the first cup portion and the first side wing panel and between the second cup portion and the second side wing panel, respectively, and the elastic shoulder straps may be formed of recycled fabric; each of the shoulder straps include an adjustable element for adjusting the length of the shoulder straps, the adjustable element being formed of a sustainable material that has a hardness value that is greater than the hardness value of the sustainable material of the pads; and/or each of the first and second cup portions may have an underwire channel. A bridge panel joins the first and second cup portions, and the free ends of the first and second side wings panels may include corresponding clasp elements for clasping the free ends together, wherein the underwire channel, the bridge panel, and the clasping elements may be formed of recycled materials.

This summary is not intended to identify essential features of the claimed subject matter, nor is it intended for use in determining the scope of the claimed subject matter. It is to be understood that both the foregoing general description and the following detailed description are exemplary and are intended to provide an overview or framework to understand the nature and character of the disclosure.

BRIEF DESCRIPTION OF THE FIGURES

The accompanying drawings are incorporated in and constitute a part of this specification. It is to be understood that the drawings illustrate only some examples of the disclosure and other examples or combinations of various examples that are not specifically illustrated in the figures may still fall within the scope of this disclosure. Examples will now be described with additional detail through the use of the drawings, in which.

DETAILED DESCRIPTION

Referring to the figures, the present disclosure generally relates to a bra garment 100 formed of sustainable and recycled materials that is environmentally friendly, non-toxic to the wearer to promote health and wellness. The bra garment 100 may be, for example a bra, sports bra, a maternity bra, a brassier, a bikini top, a camisole, other lingerie top, or other breast covering garment, such as swimwear.

The bra garment 100 may generally comprise cup portions 102*a*, 102*b*, side wing panels 104*a*, 104*b* extending from the respective cup portions 102*a*, 102*b*, and pads 108 for the cup portions 102*a*, 102*b*. Shoulder straps 106*a*, 106*b* may also be provided such that shoulder strap 106*a* connects between cup portion 102*a* and side wing panel 104*a* and shoulder strap 106*b* connects between cup portion 102*b* and side wing panel 104*b*. The pads 108 are formed of a bio-based material that provides both cushioning and support for a wearer's breasts. The remainder of the bra garment 100 may be formed of recycled materials and/or sustainable materials. As such, the entirety or substantially the entirety of the bra garment 100 can be formed of only sustainable bio-based and recycled materials.

The sustainable material in accordance with the present disclosure is a Bio-Based Open Cell Foam material that is non-toxic to the wearer and may also be devoid of fossil-fuel-based foam material and the like. The sustainable material used to form the pads 108, for example, can have hardness and density values sufficient to provide both cushioning and support to the wearer. And the sustainable material for the bra garment 100 can be manufactured by a sustainable and environment-friendly process.

The bio-based material in accordance with the present disclosure is one that is ecological, friendly, climate-friendly, green, environmental, environmentally-sound, fuel-efficient, energy-efficient, non-polluting, organic, and energy-saving. The bio-based material is a material that can be viable, continuous, continual, feasible, unceasing, livable, supportable, imperishable, unending, renewable, and green. A bio-based material is produced based on available resources to meet current needs while ensuring that adequate resources are available for future generations. In an example, the bio-based material can be a sugar cane, soy bean or corn-based polymer. Also, biodegradable additives can be added to the foam.

The cup portions 102*a* and 102*b* and the side wing panels 104*a* and 104*b* may be formed of a recycled material, such as a recycled fabric. A recycled material in accordance with the present disclosure is one that is waste converted into usable material. Recycled fabrics are waste products or fabrics and textiles that can be sorted, graded and reused again to make recycled fabrics, such synthetic fibers like polyester, nylon, and the like.

Figure 5:
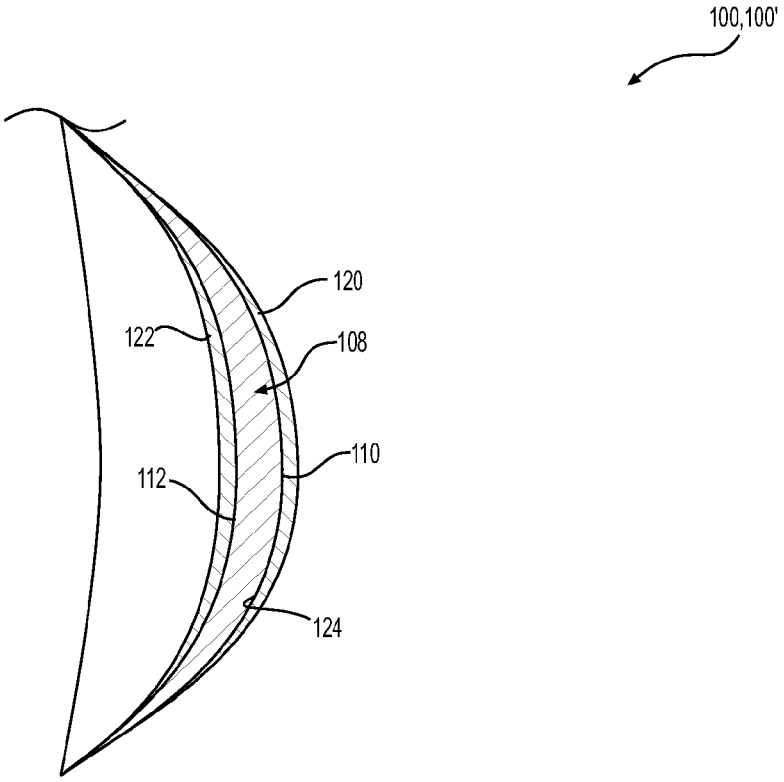
FIG. 5 is an enlarged partial cross-sectional view of a cup of the sustainable bra garment according to the present disclosure.

Each of the cup portions 102*a*, 102*b* of the bra garment 100 has an outer piece 120 and an inner piece 122 that can be attached, such as by sewing, to one another at respective perimeters thereof forming a pad receiving area 124 therebetween in which respective pads 108 are contained, as seen in FIG. 5. The outer piece 120 may have a generally convex shape selected from a number of available breast cup sizes. The inner piece may have a generally concave shape selected from a number of available cup sizes. The outer and inner pieces 120 and 122 are formed of one or more flexible materials. In an example, the outer piece can be formed of nylon or recycled nylon and the inner piece can be formed of polyester or recycled polyester. The polyester can be brushed for added softness against the wearer's skin.

Each of the pads 108 has front and back surfaces 110 and 112 that correspond to the outer and inner pieces 120 and 122, respectively, of the cup portions 102*a*, 102*b*. The front surface 110 of each pad 108 has a generally convex shape and the back surface 112 of each pad 108 has a generally concave shape, as best seen in FIG. 5. The size of the pad 108 can be any breast cup size and generally corresponds to the size of the outer and inner pieces 120 and 122 of the cup portions 102*a*, 120*b*.

Each of the pads 108 is formed of a sustainable material that is a Bio-Based Open Cell Foam material with hardness, bounce back and density values that provide both cushioning and support to breasts of a wearer of the sustainable bra garment, and that is non-toxic to the wearer. For example, the bio-based material of the pads 108 may be comprised of between about 40% to 85% Bio-Based EVA and PE Open Cell Foam or between about 40% to 85% EVA Open Cell Foam. This ratio of bio-based material provides the desired flexibility to the pads 108 as well as providing comfort and cushioning and sufficient support to the wearer.

The Open Cell Foams used for the pads 108 of the present invention, are produced by a multi-step process of mixture, extrusion, sheeting, and molding from a bio-based resin compound that may be formulated using a number of raw ingredients including, substantially Bio-Based EVA alone or a combination of Bio-Based EVA and PE as the resin base, as well as additives which act as catalysts to increase production speed and blowing agents to create gas bubbles during foam formulation. The physical properties of Bio-Based Open Cell Foams are dependent on its composition and reaction temperature at the production stage.

As a more specific example of a preferred embodiment according to the present invention, the pads 108 are formed of a bio-based material that use between 25% to 85% bio-based EVA and 5 to 45% Bio-Based Polyethylene ("PE"), both of which are comprised of substantially sugar cane-based ethanol that is converted into ethylene. A smaller percentage of an olefin block copolymer, such as Dow Infuse 9107 Olefin Block Copolymer, can be also mixed with the Bio-Based EVA and PE, which assists in controlling shrinkage and improves the elastic recovery of the resulting Bio-Based Open Cell Foam. The Bio-Based EVA (bio-based ethylene from sugarcane and vinyl acetate) is mixed together with the Bio-Based PE and olefin block copolymer, and then combined with an initiator, such as a hydrogen peroxide (or bis peroxide) and a blowing (or foaming) agent, such as an azodicarbonamide, as well as other chemicals and additives known in the art, such as a titanium dioxide which may be used as a white coloring pigment. A preferred formulation of the Bio-Based EVA and PE combination, together with other referenced components, used to form the pads 108 of the present invention is shown in the table below:

| Raw Material | PHR | % | g |
|---|---|---|---|
| SVT2180 (Bio-Based EVA) | 65.53 | 48.53 | 486 |
| SEB853 (Bio-Based PE) | 34.47 | 25.53 | 255 |
| CaCO3 (LS-625) | 17.55 | 13.00 | 130 |
| Zinc Oxide | 2.03 | 1.50 | 15 |
| Stearic Acid | 1.12 | 0.83 | 8 |
| ADCA (AC-3000F) | 13.50 | 10.00 | 100 |
| DCP 99% (BIS) | 0.82 | 0.61 | 6 |
| Total | 135.03 | 100.00 | 1000 |

*PHR- is an acronym for "per hundred parts resin"

A preferred formulation of the Bio-Based EVA and PE combination, together with an olefin block copolymer and other referenced components, used to form the pads 108 of the present invention is shown in the table below:

| Raw Material | PHR* | % | g |
|---|---|---|---|
| SVT2180 (Bio-Based EVA) | 58.06 | 43.00 | 430 |
| SEB853 (Bio-Based PE) | 27.01 | 20.00 | 200 |
| Infuse 9107 (Olefin Block Copolymer) | 14.93 | 11.06 | 111 |
| CaCO3 (LS-625) | 17.55 | 13.00 | 130 |
| Zinc Oxide | 2.03 | 1.50 | 15 |
| Stearic Acid | 1.12 | 0.83 | 8 |

-continued

| Raw Material | PHR* | % | g |
|---|---|---|---|
| ADCA (AC-3000F) | 13.50 | 10.00 | 100 |
| DCP 99% (BIS) | 0.82 | 0.61 | 6 |
| Total | 135.03 | 100.00 | 1000 |

*PHR- is an acronym for "per hundred parts resin"

Additional formulations for preferred embodiments according to the present invention may be used to form the pads 108 with a bio-based material having only bio-based EVA comprised of substantially sugar cane-based ethanol that is converted into ethylene. A preferred formulation of the Bio-Based EVA material, together with the other referenced components, used to form the pads 108 of the present invention is shown in the table below:

| Raw Material | PHR | % | g |
|---|---|---|---|
| SVT2180 (Bio-Based EVA) | 100 | 75.67 | 757 |
| CaCO3 (LS-625) | 16 | 12.11 | 121 |
| Zinc Oxide | 2.0 | 1.51 | 15 |
| Stearic Acid | 1.0 | 0.76 | 7.6 |
| ADCA (AC-3000F) | 12.3 | 9.3 | 93 |
| DCP 99% (BIS) | 0.85 | 0.64 | 6.4 |
| Total | 132.15 | 100.00 | 1000 |

The bio-based material having only bio-based EVA may also be combined with an olefin block copolymer, such as Dow Infuse 9107 Olefin Block Copolymer. A preferred formulation of the Bio-Based EVA material, together with an olefin block copolymer and other referenced components, used to form the pads 108 of the present invention is also shown in the table below:

| Raw Material | PHR | % | g |
|---|---|---|---|
| SVT2180 (Bio-Based EVA) | 85 | 63.26 | 632.6 |
| Infuse 9107 (Olefin Block Copolymer) | 15 | 11.16 | 111.6 |
| CaCO3 (LS-625) | 18 | 13.4 | 134 |
| Zinc Oxide | 2.0 | 1.49 | 15 |
| Stearic Acid | 1.0 | 0.74 | 7.4 |
| ADCA (AC-3000F) | 12.5 | 9.3 | 93 |
| DCP 99% (BIS) | 0.86 | 0.64 | 6.4 |
| Total | 132.15 | 100.00 | 1000 |

Figure 6A:
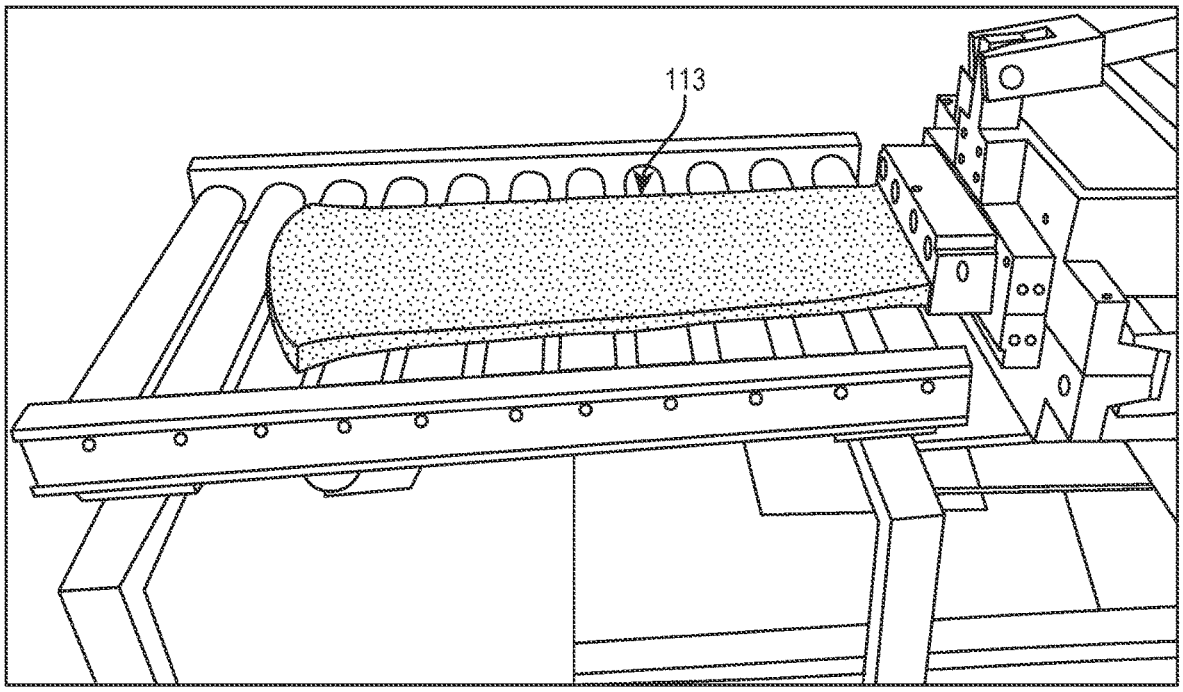
FIG. 6*a* is a side perspective view of a melt mixture for the bio-based foam material during a single screw extrusion step to form the mixture into a shape.

A preferred method to form the Bio-Based Open Cell Foam used for the pads 108 of the present invention includes, heating the Bio-Based EVA/PE formulation from room temperature to a temperature of between about 105° C. (221° F.) to about 130° C. (about 266° F.) to create a melt mixture that resembles the consistency of a dough. Such a mixture is then extruded in a single screw extruder. The preferred extrusion temperature can range from between about 80° C. (about 176° F.) to about 90° C. (about 194° F.) to form the mixture into a shape 113 as shown in FIG. 6*a*. This shape 113 should preferably be kept (during the remainder of the extrusion process) at temperatures of between about 60° C. (about 140° F.) to about 90° C. (about 194° F.) to maintain the extruded shape, after which the shape is compressed using a pass-through pressing belt to form a substantially flat sheet. The volumetric shape of the substantially flat sheet is then expanded through a two-step heating process comprising: 1) heating said sheet to a temperature of between about 135° C. (about 275° F.) to about 150° C. (about 300° F.) for a duration of between about 30 to 45 minutes to obtain a substantially cross-linked foam material, preferably a 100% crosslinked ratio, with limited to moderate volumetric expansion, and 2) heating said sheet to between about 160° C. (about 320° F.) to about 185° C. (about 365° F.) for a duration of between about 90 to about 150 minutes to obtain a substantial volumetric expansion. The volumetric expansion of the foam shape can be as much as about 36-38 times of the original shape to form a foam sheet. Following the second heating process, the Bio-Based foam sheet is preferably subjected to a cooling process within the mold. A preferred cooling process may use cold water at about 15° Celsius (about 59° F.) for a duration of between about 70 to 90 minutes. After the completion of the second (heating) step of the two-step process, a block 114*a* with preferred dimensions of about 2.4 meter in length, 1 meter wide and 90 mm in thickness will result.

Figure 6B:
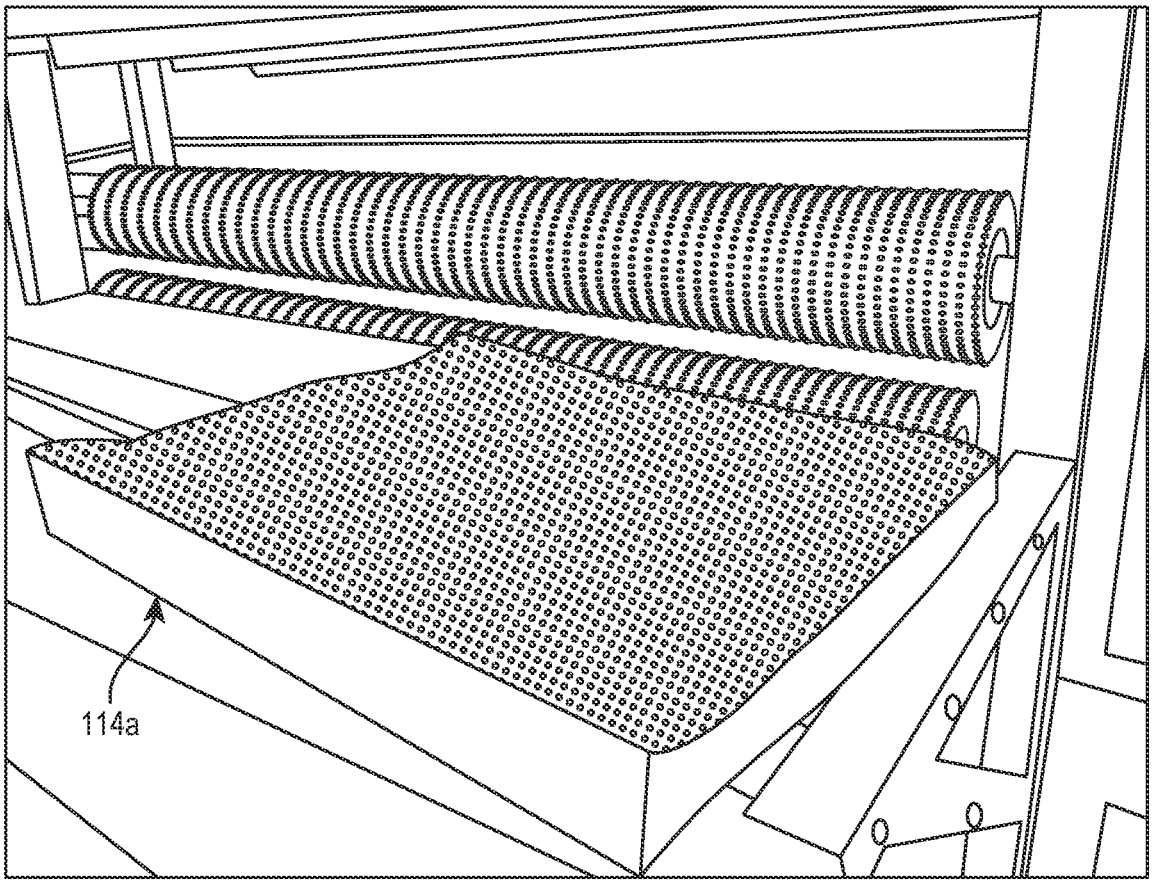
FIG. 6*b* is a perspective view of a foam block (or bun) of the bio-based foam material before being subjected to multiple crushing steps through a compression roller process to transition the foam to an open cell structure.
Figure 6C:
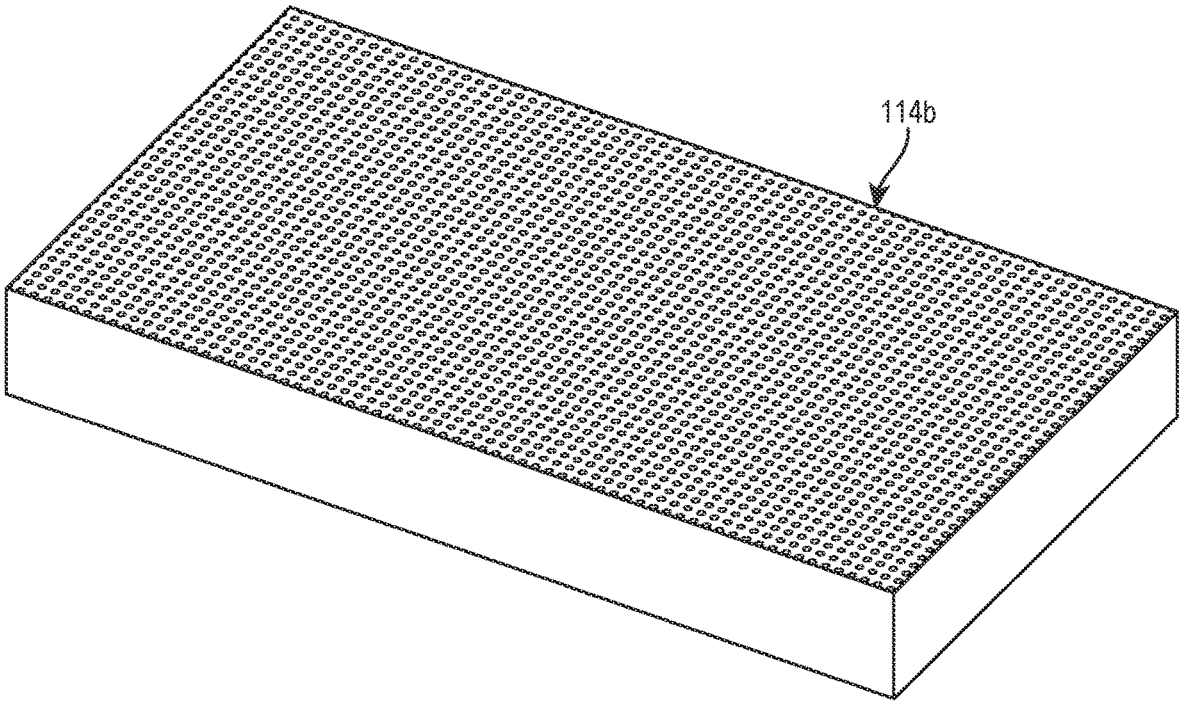
FIG. 6*c* is a perspective view of a foam block (bun) of the bio-based foam material after heating in an oven to restore the foam block's thickness subsequent to the crushing process.

The foam block (or bun) 114*a* is preferably kept at room temperature for about 24 hours before being subjected to multiple crushing steps through a compression roller process as shown in FIG. 6*b*, to obtain an open cell structure within the foam block 114*a*. A preferred compression roller process is performed by passing the foam block 114*a* through a compression roller machine for about two back and forth cycles, such that the foam block 114*a* is crushed between the rollers at least about 4 times, to release as much air from inside the foam as possible. The foam block may also be subsequently heated in an oven at a temperature of between about 165° to 175° C. for 40 to 50 minutes, which serves to restore the foam block's thickness and results in an open cell foam block 114*b* as shown in FIG. 6*c* after the crushing process.

Figure 6D:
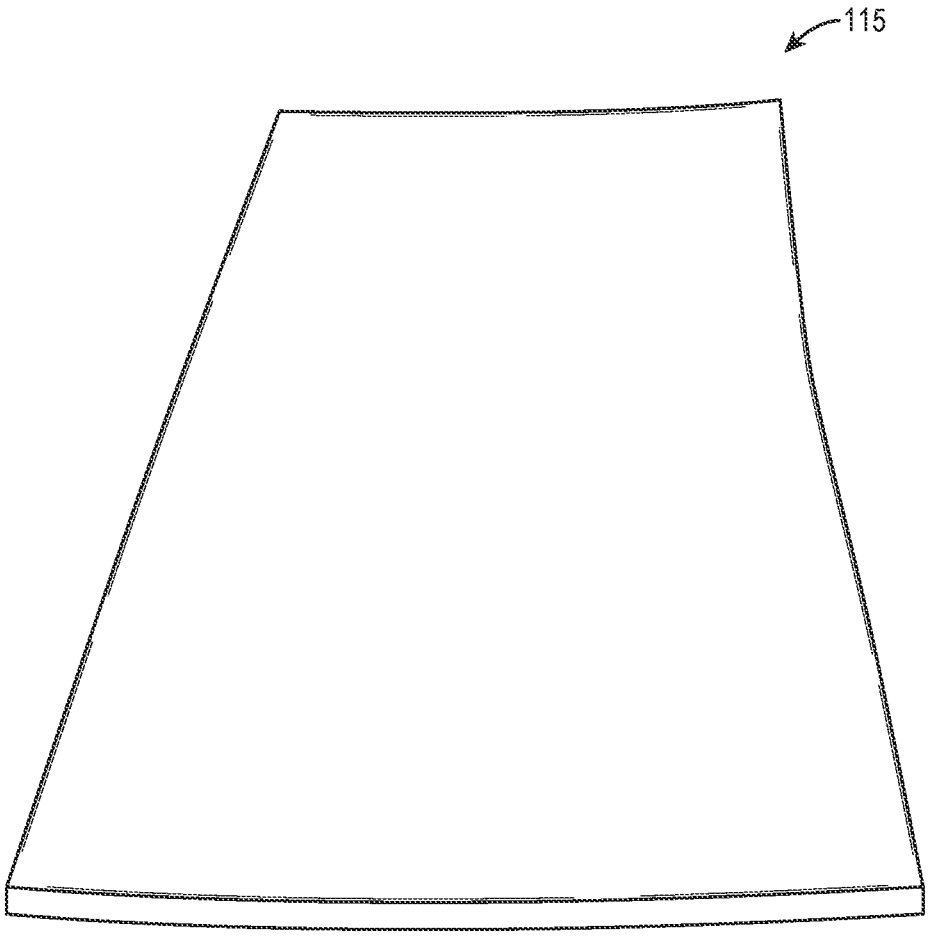
FIG. 6*d* is a front perspective view of a bio-based open cell foam sheet used for forming one or more pads made in accordance with the present disclosure.

The open cell foam block is thereafter cut or sliced into thinner sheets, preferably ranging in thickness from about 4 mm to about 13 mm. An example of a resulting bio-based open cell foam sheet of the present invention 115 is shown in FIG. 6*d*, which can be used as material for forming one or more pads 108.

The foam sheets 115 have a range of hardness, measured on an ASTM D2240 standard, from about 3 to about 50 on a Shore 00 scale and a preferable hardness from about 6 to 25 on a Shore 00 scale.

It was also determined that the density of a foam sheet 115 is in the range of about 0.020 to about 0.045 g/cm3, with a preferred density range of about 0.025 to about 0.035 g/cm3 using an ISO 845 test standard as a preferred method. The ISO 845 test standard is commonly used to describe the determination of the specific gravity (relative density) and density of samples of solid plastics in forms such as sheets, rods, tubes, or molded items such as the open cell foam sheets 115 described herein (FIG. 6*d*).

The bio-based foam sheet 115 may thereafter be laminated with fabrics such as polyester, polyamide, nylon, polyester and nylon blend, and the like. An example of a preferred fabric is 100% polyester, Double-sided 72D superfine brushed fabric. In a preferred lamination process, an adhesive glue is used to affix the fabric to the foam sheet, such as an NEL-1018 hot melt polyurethane adhesive with a preferred viscosity of 10,000 (±2,000 cps ("centipoise")/100° C. A preferred glue quantity is 25 grams per square meter of foam sheet with a fabric lamination temperature of 95° C. The duration of the lamination process to completion, including the setting and drying of the laminated foam sheet is preferably about 24 hours.

Figure 7:
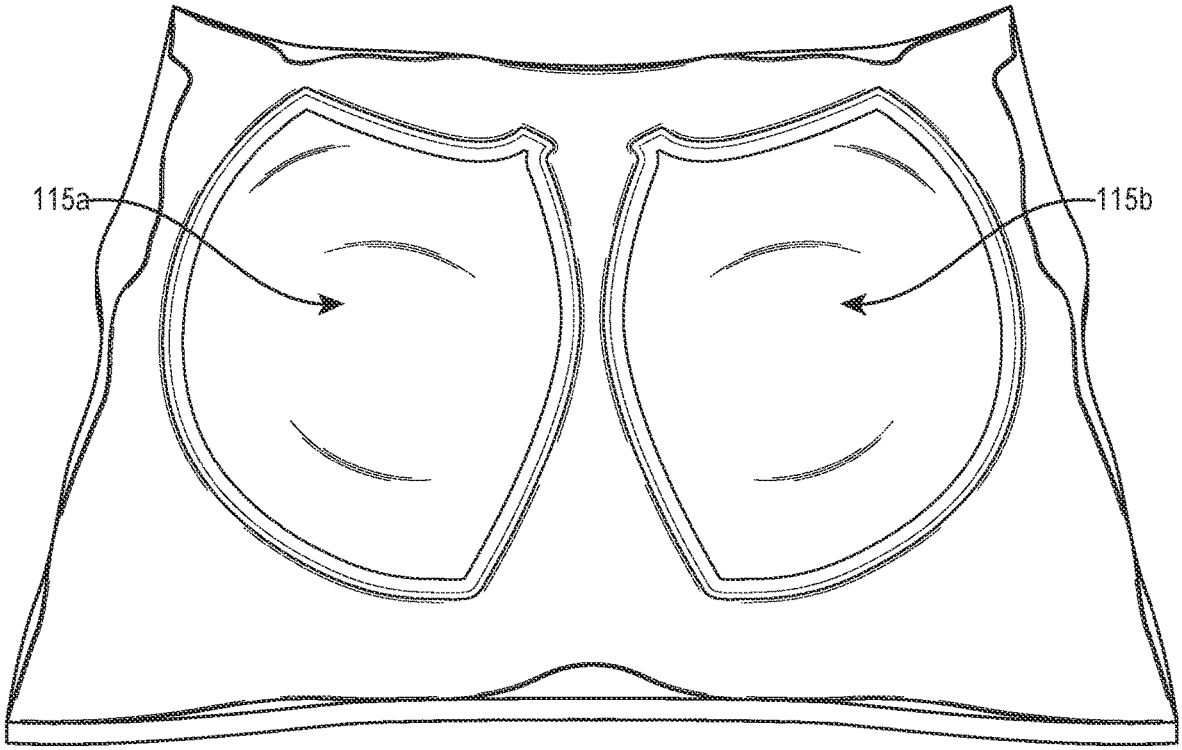
FIG. 7 is a front perspective view of pad portions partially formed from a bio-based open cell foam sheet, as illustrated in FIG. 6, made in accordance with the present disclosure.

The Bio-Based Open Cell Foam sheet 115 is then formed into partial pad portions 115*a* and 115*b* (FIG. 7). A preferred molding method to form a standard cushioning cup portion comprises: 1) heating a portion of said Bio-Based Open Cell Foam sheet within a mold to between about 70° C. (160° F.) to about 120° C. (248° F.) for a first press of between about 80 to about 160 seconds in duration, and thereafter 2) heating said Bio-Based Open Cell Foam sheet within said mold to between about 20° C. (68° F.) to about 60° C. (140° F.) for a second press of between about 60 seconds to about 120 seconds in duration, and 3) cooling in a press the said Bio-Based Open Cell Foam at room temperature for between about 30 seconds to about 70 seconds in duration; such that each said partial pad portion (115*a* and 115*b*) is formed within said mold into a shape having an inner surface substantially concave in shape and an outer surface substantially convex in shape and resulting in pad portions having hardness values of between about 20 to about 70 on a Shore 00 scale and preferred hardness values of between about 35 to about 55 on a Shore 00 scale. Examples of partially formed pad portions 115*a* and 115*b* are shown in process in FIG. 7 after forming of the pad cup portions using the above preferred molding methods.

Figure 8:
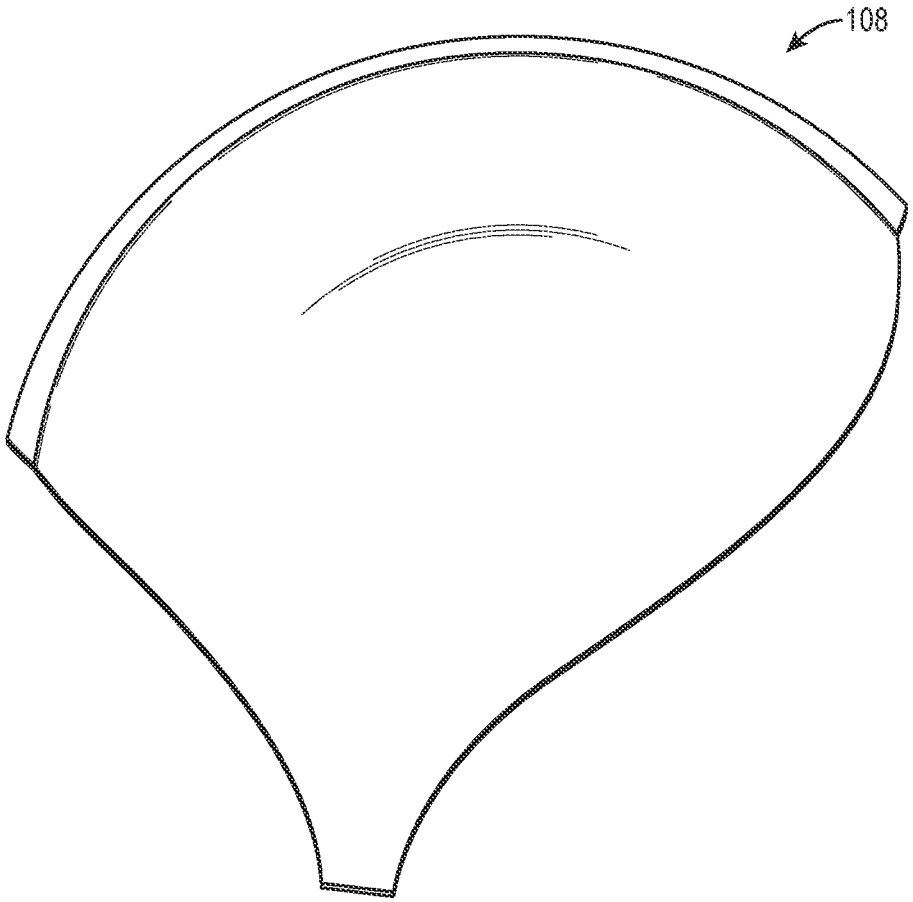
FIG. 8 is a front or elevational view of a finished pad made according to the present disclosure.

An example of a finished pad portion 108 made in accordance with the above processing methods is shown in FIG. 8. In addition to the above-preferred molding methods, several molding method time and temperature variations can be employed to yield pad portions having various cup sizes and styles, such as the various methods for making multiple styles in the table disclosed below:

Molding Conditions

| Style | 1st press temperature (° C.) | 1st press time (seconds) | 2nd press temperature (° C.) | 2nd press time (seconds) | 3rd press temperature (° C.) | 3rd press time (seconds) |
|---|---|---|---|---|---|---|
| T-Shirt Pad | 90-100 | 100 | Room temperature | 100 | Not Applicable | Not Applicable |
| Balconette Pad | 90-100 | 200 | Room temperature | 100 | Not Applicable | Not Applicable |
| Push-Up Pad | 90-100 | 200 | Room temperature | 130 | Room temperature | 50 |

Several such pad portion samples were subjected to an ASTM test method to assess a preferred range of pad material hardness properties. The material hardness of each sample ranging from cup sizes of 32A to 44G (United States of America standard sizes) was determined at various surface points by subjecting samples to a standard ASTM D2240 test method using a durometer having a Shore 00 scale to measure the material hardness. It was determined after such hardness testing that a range of Shore 00 hardness values of between about 20 to about 70 was observed, with a resulting preferred Shore 00 material hardness range of between about 35 to about 55, to provide both appropriate cushioning and sufficient support for the breasts of a wearer of a sustainable bra garment or other garment in which such pads 108 are incorporated.

It has been determined that a Bio-Based carbon content of 77% can be achieved in samples of a finished pad portion 108. The Bio-Based carbon content of finished pad portion samples was determined through a standard ASTM D6866 (Method B) analysis which indicates a percentage carbon from "natural" (plant or animal by-product) sources versus "synthetic" (petrochemical) sources. For reference, 100% Biobased Carbon indicates that a material is entirely sourced from plants or animal by-products and 0% Biobased Carbon indicates that a material did not contain any carbon from plants or animal by-products. A value in between represents a mixture of natural and fossil fuel sources, as was found in the finished pad portions 108 described herein.

The front surface 110 of each pad 108 may also be laminated to assist with application of the outer piece 120 of the cup portions 102*a*, 120*b*. The back surface 112 of each pad 108 may be devoid of any lamination. Alternatively, each pad 108 can be devoid of any lamination altogether, i.e. on either the front or back surface 110 and 112 thereof.

Each of the side wing panels 104*a*, 104*b* is connected to an outer edge of a respective cup portion 102*a*, 102*b*. The side wing panels 104*a*, 104*b* can be formed of one or more fabrics, such as nylon, recycled nylon and the like. The side wing panels 104*a*, 104*b* can be made of the same or different recycled fabric as that of the cup portions 102*a*, 102*b*. Also, recycled yarns may be used for sewing the perimeters of any of the portions or panels of the bra garment 100, such as the perimeters 109 around the side wing panel 104*a*, 104*b*. The free ends of the side wings panels 104*a*, 104*b* include corresponding clasp elements 130 and 132, respectively, such as hook and eye elements, for clasping the free ends together in a conventional manner. The clasp elements 130 and 132 may be formed of recycled materials, such as recycled metal for the hook, and fabric or yarn for the eye.

The shoulder straps 106*a*, 106*b* may be formed of recycled materials, such as a recycled elastic material, such as recycled yarns and the like, to provide flexibility and comfort to the wearer. Each shoulder strap 106*a* and 106*b* may be adjustable using adjustable elements such as corresponding ring and hook members 134 and 136, which function as is known in the art. The ring and hook members 134 and 136 may be formed of a sustainable material, such as a sugar cane polymer. The sugar cane polymer of the ring and hook members 134 and 136 would be harder and more rigid that the sugar cane polymer which forms the pads 108. That is, the sugar cane polymer of the ring and hook members 134 and 136 have a sufficient hardness value and rigidity to couple to the shoulder straps 106*a*, and 106*b* to allow adjustment thereof.

Figure 1:
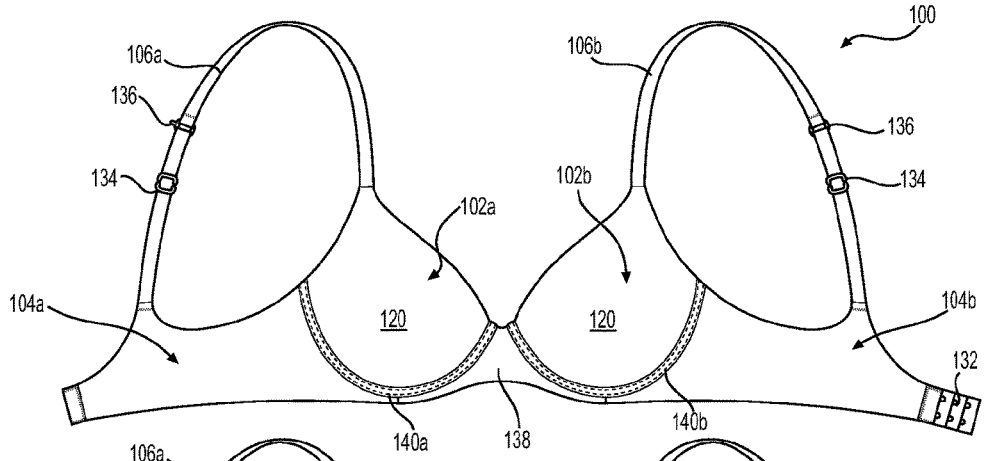
FIG. 1 is a front or outside elevational view of an exemplary sustainable bra garment, according to present disclosure.
Figure 2:
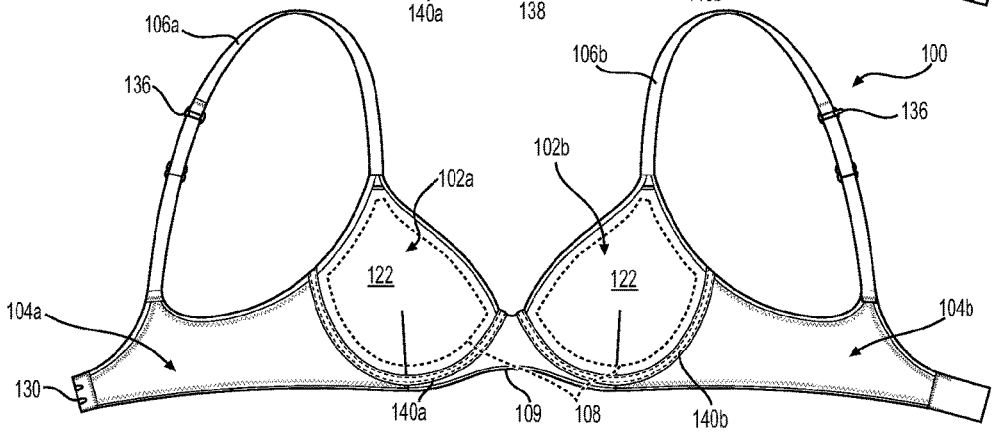
FIG. 2 is a rear or inside elevational view of the sustainable bra garment illustrated in FIG. 1.
Figure 3:
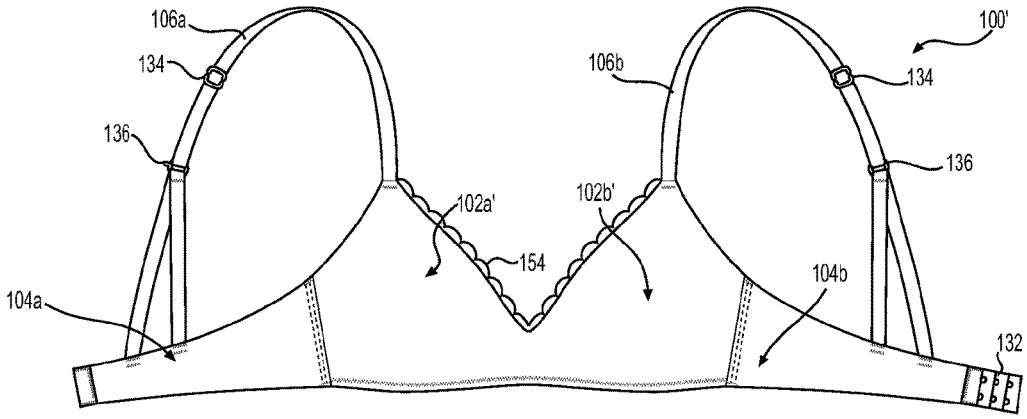
FIG. 3 is a front or outside elevational view of another exemplary sustainable bra garment, according to present disclosure.
Figure 4:
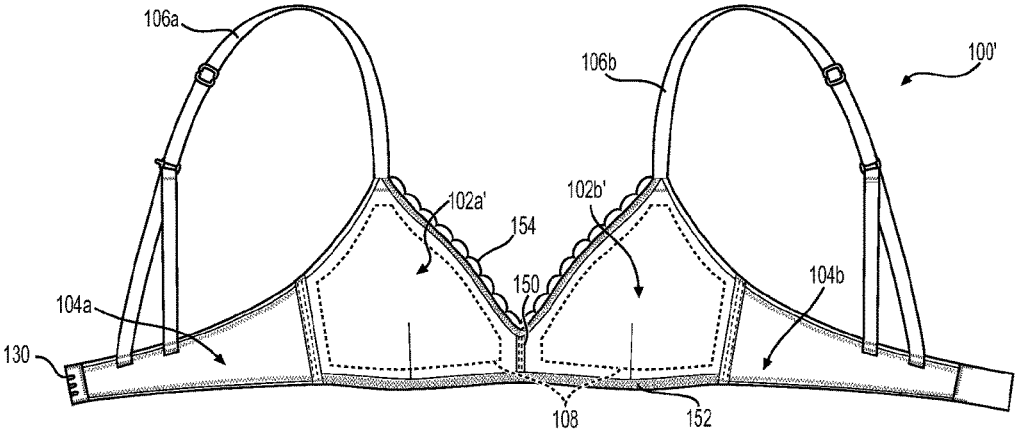
FIG. 4 is a rear or inside elevational view of the sustainable bra garment illustrated in FIG. 3.

The bra garment 100 may include an underwire, as seen in FIGS. 1 and 2, or the bra garment 100' may not have underwire, as seen in FIGS. 3 and 4. The bra garment 100 has an underwire channels 140*a*, 140*b* at the bottom of supports 102*a*, 102*b*, respectively. The underwire channels 140*a*, 104*b* may be formed of recycled fabrics, such as recycled yarns, and are sized to receive a conventional underwire. A bridge panel 138 extends between the underwire channels 140*a*, 140*b* to join the cup portions 102*a*, 102*b*. The bridge panel 138 can be formed of a recycled material, such as recycled nylon.

The bra garment 100' as seen in FIGS. 3 and 4, is substantially the same as the bra garment 100 of FIGS. 1 and 2, except that it does not have an underwire or underwire channels. The cup portions 102*a*', 102*b*' of the bra garment 100' are the same as cup portion 102*a*, 102*b*, except that the cup portions 102*a*, 102*b*' are sewn together, using recycled yarn for example, at a center line 150 and a bottom line 152, as best seen in FIG. 4. An optional lace trim 154 may be provide at the top of the cup portions 102*a*', 120*b*'. The lace trim 154 can be formed of a recycled material, such as recycled yarn and the like.

It will be apparent to those skilled in the art having the benefit of the teachings presented in the foregoing descriptions and the associated drawings that modifications, combinations, sub-combinations, and variations can be made without departing from the spirit or scope of this disclosure. Likewise, the various examples described may be used individually or in combination with other examples. Those skilled in the art will appreciate various combinations of examples not specifically described or illustrated herein that are still within the scope of this disclosure. In this respect, it is to be understood that the disclosure is not limited to the specific examples set forth and the examples of the disclosure are intended to be illustrative, not limiting.

The following definitions and terms are used in this disclosure:

EVA: As used in this disclosure, "EVA" is an acronym known and used in the art as a reference to_"ethylene-vinyl-acetate", an elastic petroleum-based polymer that can be used to produce materials and products with a rubber-like softness and flexibility.

Bio-Based EVA: As used in this disclosure, "Bio-Based EVA" is used to describe a carbon negative material made substantially from sugarcane (sugarcane ethanol) and used as an alternative and/or substitute for petroleum-based EVA polymers. Existing bio-based EVA materials are available commercially and are supplied by Braskem as an EVA resin. Preferred resins are identified as EVA Evance SVT2145 and SVT2180, which are typically in the form of pellets and processed to obtain foam sheets for use in the soles of footwear products, or in toys and furniture.

Polyethylene ("PE"): As used in this disclosure, "Polyethylene" or "PE" is used to describe a synthetic resin made from the polymerization of ethylene. Polyethylene is a member of an important family of polyolefin resins and is one of the most widely used plastics world-wide, being made into products ranging from clear food wrap and shopping bags to detergent bottles and automobile fuel tanks. It can also be slit or spun into synthetic fibers or modified to take on the elastic properties of a rubber.

Bio-Based PE: As used in this disclosure, "Bio-Based PE" is used to describe a synthetic resin of polyethylene having a high proportion of renewable raw materials such as sugar cane as the starting material Open Cell Foam: As used in this disclosure, "Open Cell Foam" is used to describe a foam material comprised of a series of inter-connecting cells with an open structure, which enhance the elastic properties of the cells. When compressed, cells collapse together tightly in any direction, and when compression is released, the air intake allows the padding to return to its original state quickly. Open cells are less likely to be broken, resulting in superior performance when used overtime. Open cells are typically less dense than closed cell foams, although depending on the application, the composition of the padding can be altered to increase density.

Closed Cell Foam: As used in this disclosure, "Closed Cell Foam" is made up of a series of enclosed air pockets, comparable to small balloons or rubber balls compacted within a rubber membrane. When compressed, air is released through the cell walls and the air pockets are squashed down to small disc shapes. When compression is released, air enters back through the cell walls at a slower rate than open cells. Closed cells tend to be stiffer or more rigid due to this giving them superior resistance to moisture, ideal for use in damp applications such as gasketing and insulation. Similar to open cell padding, closed cell composition can be altered to amend its density, rigidity, compression resistance and other properties.

Hydrogen peroxide or bis (trifluormethyl) peroxide: As used in this disclosure, "hydrogen peroxide" or "bis peroxide" is used to describe a chemical used as an initiator (or catalyst) for unsaturated ethylene-like molecules in the production of stable polymeric materials, including as an initiator for Bio-Based EVA and PE to yield a cross-linked Open Cell Foam having enhanced mechanical properties. Examples of appropriate cross-linking peroxides for open cell foams are Perkadox® BC-FF (Nouryon) and Luperox® 802 (Arkema).

Blowing or Foaming Agent: As used in this disclosure, a "blowing agent" or "foaming agent" is used to describe chemical compositions used in state-of-the-art polymerization processes, typically an azodicarbonamide, capable of producing a cellular structure through a foaming process to reduce density and increase relative stiffness of a base polymer. It has also been determined that more eco-friendly compositions, such as sodium bicarbonate (Alve-One™ commercially available from Solvay), may also be used as effective blowing or foaming agents to form Bio-Based EVA and PE Open Cell Foams. Another example of an appropriate and commercially available foaming agent is Hydrocerol (Avient).

Zinc Oxide—As used in this disclosure "zinc oxide" is used to describe what is known in the art as a "kicker", which is typically added to the formulation to assist with heat flow distribution inside of the foam and to decrease the temperature of the blowing or foaming agent, such as an azodicarbonamide, during the blowing or foaming process.

Titanium dioxide or titanium IV oxide [TiO2]—As used in this disclosure, "titanium dioxide" or "titanium IV oxide" is used to describe a substance typically used as a pigment (also known as "titanium white") for paints and polymers.

Shore Hardness/Asker Hardness—As used in this disclosure, "Shore Hardness" and "Asker Hardness" are terms used to describe the measure of hardness of a given material (or how resistant it will be to permanent indentation), measured by the depth of indentation that is created on the material with a specified force. The measuring instrument typically used is known as a durometer, and different respective scales for measuring hardness (such as Asker, Shore, Rockwell hardness scales) are known in the art. Accordingly, different hardness scales are used for measuring the solidity of different materials with varying properties, like rubbers, polymers and elastomers. The most commonly used scales for measuring the hardness of rubber materials are the Asker C and Shore 00 or A scales for softer materials and the Shore D scale for harder materials. The Asker C, Asker F and Shore 00 scales are generally used for measuring hardness of more flexible foam or rubber materials.

As used in this specification and the appended claims, the singular forms "a", "an" and "the" include plural referents, unless the context clearly dictates otherwise. Similarly, the adjective "another," when used to introduce an element, is intended to mean one or more elements. The terms "comprising," "including," "having" and similar terms are intended to be inclusive such that there may be additional elements other than the listed elements.

Additionally, where a method described above does not explicitly require an order to be followed by its steps or an order is otherwise not required based on the description or claim language, it is not intended that any particular order be inferred. Likewise, where a method claim below does not explicitly recite a step mentioned in the description above, it should not be assumed that the step is required by the claim.

It is noted that the description and claims may use geometric or relational terms. These terms are not intended to limit the disclosure and, in general, are used for convenience to facilitate the description based on the examples shown in the figures. In addition, the geometric or relational terms may not be exact. For instance, walls may not be exactly perpendicular or parallel to one another because of, for example, roughness of surfaces, tolerances allowed in manufacturing, etc., but may still be considered to be perpendicular or parallel.

What is claimed is:

1. A bio-based cushioning support pad for use in a bra garment or other garment, comprising:

a pad portion formed of one or more bio-based foam materials, comprising at least about 40-85% bio-based EVA and bio-based PE formed substantially from sugar cane-based ethylene;

said bio-based EVA and PE combined with at least;

a peroxide-based initiator, and a foaming agent;

said bio-based EVA, bio-based PE, peroxide-based initiator and foaming agent mixture formed into a substantially flat sheet by methods comprising;

the addition of heat to a temperature of between about 105° C. to about 130° C. to form a melt mixture, extruding said melt mixture to form said mixture into a shape, maintaining said shape during extrusion at a temperature of between at least about 60° C. to about 90° C., and compressing said shape to form a substantially flat sheet;

expanding the volume of said substantially flat sheet by a heating method comprising;

heating said sheet to between about 135° C. to about 150° C. for between about 30 to 45 minutes to obtain a substantially cross-linked foam material with limited volumetric expansion, heating said sheet to between about 160° C. to about 185° C. for between about 90 to about 150 minutes to obtain a substantial volumetric expansion, wherein a bio-based foam block is formed;

crushing said bio-based foam block through a multiple compression roller process comprising;

crushing said bio-based foam block between compression rollers at least about 4 times, to release a substantial volume of air from inside said bio-based foam block, wherein an open cell foam block is formed;

cutting said open cell foam block into sheets;

shaping said bio-based open cell foam sheets into pad portions, said pad portions formed within a mold into a shape having an inner surface substantially concave in shape and an outer surface substantially convex in shape.

2. The bio-based cushioning support pad of claim 1, wherein the said bio-based EVA and PE is also combined with an olefin block copolymer.

3. The bio-based cushioning support pad of claim 1, wherein said bio-based foam material is comprised of at least about 40-85% bio-based EVA formed substantially from sugar cane-based ethylene.

4. The bio-based cushioning support pad of claim 3, wherein the bio-based EVA is combined with an olefin block copolymer.

5. The bio-based cushioning support pad of claim 1, wherein following the compression roller process said foam block is heated to between about 165° C. to about 175° C. for between about 40 to about 50 minutes to substantially restore the thickness of said foam block.

6. The bio-based cushioning support pad of claim 1, wherein said pad portion having a Shore 00 hardness value of at least about 20 to about 70.

7. The bio-based cushioning support pad of claim 1, wherein said pad portion is comprised of a bio-based carbon content of between about 40% to about 90%.

8. The bio-based cushioning support pad of claim 1, wherein said sheet formed by said cutting method is comprised of an open cell foam having a density in the range of about 0.020 to about 0.045 g/cm3.

9. The bio-based cushioning support pad of claim 1, wherein said pad portion is formed by a molding method comprising;

heating said bio-based open cell foam sheets within a mold to between about 70° C. to about 120° C. for a first press of between about 80 to about 140 seconds in duration, re-heating said bio-based foam sheets within said mold to between about 20° C. to about 60° C. for a second press of between about 60 to about 120 seconds in duration, and cooling said bio-based foam sheets within said mold to about room temperature for between about 30 seconds to about 70 seconds in duration;

wherein said partial pad portion is formed within said mold into a shape having an inner surface substantially concave in shape and an outer surface substantially convex in shape.

10. A method for making bio-based cushioning support pads for use in a bra garment or other garment, comprising:

At least one pad portion formed of one or more bio-based foam materials, comprising at least about 40-85% bio-based EVA and bio-based PE formed substantially from sugar cane-based ethylene;

said bio-based EVA and PE combined with at least;

a peroxide-based initiator, and a foaming agent;

said bio-based EVA, bio-based PE, peroxide-based initiator and foaming agent mixture formed into a substantially flat sheet by methods comprising;

the addition of heat to a temperature of between about 105° C. to about 130° C. to form a melt mixture, extruding said melt mixture to form said mixture into a shape, maintaining said shape during extrusion at a temperature of between at least about 60° C. to about 90° C., and compressing said shape to form a substantially flat sheet;

expanding the volume of said substantially flat sheet by a heating method comprising;

heating said sheet to between about 135° C. to about 150° C. for between about 30 to 45 minutes to obtain a substantially cross-linked foam material with limited volumetric expansion, heating said sheet to between about 160° C. to about 185° C. for between about 90 to about 150 minutes to obtain a substantial volumetric expansion, wherein a bio-based foam block is formed;

crushing said bio-based foam block through a multiple compression roller process comprising;

crushing said bio-based foam block between compression rollers at least about 4 times, to release a substantial volume of air from inside said bio-based foam block, wherein an open cell foam block is formed;

cutting said open cell foam block into sheets;

shaping said bio-based open cell foam sheets into pad portions, said pad portions formed within a mold into a shape having an inner surface substantially concave in shape and an outer surface substantially convex in shape.

11. The method of claim 10, wherein said bio-based EVA and PE is also combined with an olefin block copolymer.

12. The method of claim 10, wherein said bio-based foam material is comprised of at least about 40% to about 85% bio-based EVA formed substantially from sugar cane-based ethylene.

13. The method of claim 12, wherein the bio-based EVA is combined with an olefin block copolymer.

14. The method of claim 10, wherein following the compression roller process said foam block is heated to between about 165° C. to about 175° C. for between about 40 to about 50 minutes to substantially restore the thickness of said foam block.

15. The method of claim 10, wherein said pad portion having a Shore 00 hardness value of at least about 25 to about 65.

16. The method of claim 10, wherein said pad portion is comprised of a bio-based carbon content of between about 50% to about 90%.

17. The method of claim 10, wherein said pad portion is formed by a molding method comprising;

heating said bio-based open cell foam sheets within a mold to between about 70° C. to about 120° C. for a first press of between about 80 to about 140 seconds in duration, re-heating said bio-based foam sheets within said mold to between about 20° C. to about 60° C. for a second press of between about 60 to about 120 seconds in duration, and cooling said bio-based foam sheets within said mold to about room temperature for between about 30 seconds to about 70 seconds in duration;

wherein said partial pad portion is formed within said mold into a shape having an inner surface substantially concave in shape and an outer surface substantially convex in shape.

18. A bra garment, comprising:

first and second cup portions that are formed of one or more recycled flexible materials;

first and second side wing panels extending from the first and second cup portions, respectively, the first and second side wing panels being formed of one or more recycled flexible materials; and first and second cushioning support pads configured to be coupled with the first and second cup portions, respectively, each of said pads having front and back surfaces, the front surface of each pad having a generally convex shape and the back surface of each pad having a generally concave shape;

each of said pads being formed of a bio-based open cell foam material that has hardness and density values that provide both cushioning and support to breasts of a wearer of the bra garment;

said bio-based open cell foam material comprising at least about 60-85% bio-based EVA and bio-based PE mixture formed substantially from sugar cane-based ethylene;

said bio-based EVA and PE mixture combined with at least;

a peroxide-based initiator, and a foaming agent;

said bio-based EVA, bio-based PE, peroxide-based initiator and foaming agent mixture formed into a substantially flat sheet by methods comprising;

the addition of heat to a temperature of between about 105° C. to about 130° C. to form a melt mixture, extruding said melt mixture to form said mixture into a shape, maintaining said shape during extrusion at a temperature of between at least about 60° C. to about 90° C., and compressing said shape to form a substantially flat sheet;

expanding the volume of said substantially flat sheet by a heating method comprising;

heating said sheet to between about 135° C. to about 150° C. for between about 30 to 45 minutes to obtain a substantially cross-linked foam material with limited volumetric expansion, heating said sheet to between about 160° C. to about 185° C. for between about 90 to about 150 minutes to obtain a substantial volumetric expansion, wherein a bio-based foam block is formed;

crushing said bio-based foam block through a multiple compression roller process comprising;

crushing said bio-based foam block between compression rollers at least about 4 times, to release a substantial volume of air from inside said bio-based foam block, wherein an open cell foam block is formed;

cutting said open cell foam block into sheets;

shaping said bio-based open cell foam sheets into pad portions, said pad portion formed within a mold into a shape having an inner surface substantially concave in shape and an outer surface substantially convex in shape.

19. The bra garment of claim 18, wherein said bio-based EVA and PE is also combined with an olefin block copolymer.

20. The bra garment of claim 18, wherein said bio-based foam material is comprised of at least about 40% to about 85% bio-based EVA formed substantially from sugar cane-based ethylene.

21. The bra garment of claim 20, wherein the bio-based EVA is combined with an olefin block copolymer.

22. The bra garment of claim 18, wherein following the compression roller process said foam block is heated to between about 165° C. to about 175° C. for between about 40 to about 50 minutes to substantially restore the thickness of said foam block.

23. The bra garment of claim 18, wherein said first and second cushioning support pads having a Shore 00 hardness value of at least about 20 to about 70.

24. The bra garment of claim 18, wherein said first and second cushioning support pads are comprised of a bio-based carbon content of between about 40% to about 90%.

25. The bra garment of claim 18, wherein the said sheet formed by said cutting method is comprised of an open cell foam having a density in the range of about 0.020 to about 0.045 g/cm3.

26. A method for making a bio-based open-cell foam block for use in manufacturing cushioning support pads for a bra garment or other garment, comprising;

one or more bio-based foam materials, comprising at least about 40-85% bio-based EVA and bio-based PE formed substantially from sugar cane-based ethylene;

said bio-based EVA and PE combined with at least;

a peroxide-based initiator, and a foaming agent;

said bio-based EVA, bio-based PE, peroxide-based initiator and foaming agent mixture formed into a substantially flat sheet by methods comprising;

the addition of heat to a temperature of between about 105° C. to about 130° C. to form a melt mixture, extruding said melt mixture to form said mixture into a shape, maintaining said shape during extrusion at a temperature of between at least about 60° C. to about 90° C., and compressing said shape to form a substantially flat sheet;

expanding the volume of said substantially flat sheet by a heating method comprising;

heating said sheet to between about 135° C. to about 150° C. for between about 30 to 45 minutes to obtain a substantially cross-linked foam material with limited volumetric expansion, heating said sheet to about 160° C. to about 185° C. for between about 90 to about 150 minutes to obtain a substantial volumetric expansion, wherein a bio-based foam block is formed;

crushing said bio-based foam block through a multiple compression roller process comprising;

crushing said bio-based foam block between compression rollers at least about 4 times, to release a substantial volume of air from inside said bio-based foam block, wherein an open cell foam block is formed.

27. The method of claim 26, wherein following the compression roller process said foam block is heated to between about 165° C. to about 175° C. for between about 40 to about 50 minutes to substantially restore the thickness of said foam block.

28. The method of claim 26, wherein said bio-based EVA and PE is also combined with an olefin block copolymer.

29. The method of claim 26, wherein said bio-based foam material is comprised of at least about 40% to about 85% bio-based EVA formed substantially from sugar cane-based ethylene.

30. The method of claim 29, wherein said bio-based EVA is also combined with an olefin block copolymer.

* * * * *